US012268293B2

(12) United States Patent
Gillespie

(10) Patent No.: US 12,268,293 B2
(45) Date of Patent: Apr. 8, 2025

(54) DRINKWARE APPARATUS

(71) Applicant: Zak Designs, Inc., Spokane, WA (US)

(72) Inventor: Andrew Gillespie, North Easton, MA (US)

(73) Assignee: Zak Designs, Inc., Spokane, WA (US)

( * ) Notice: Subject to any disclaimer, the term of this patent is extended or adjusted under 35 U.S.C. 154(b) by 123 days.

(21) Appl. No.: 17/964,022

(22) Filed: Oct. 11, 2022

(65) Prior Publication Data

US 2024/0115035 A1 Apr. 11, 2024

(51) Int. Cl.
*A45F 5/10* (2006.01)
*A45F 3/16* (2006.01)

(52) U.S. Cl.
CPC ..... *A45F 5/10* (2013.01); *A45F 3/16* (2013.01); *A45F 2005/1013* (2013.01); *A45F 2200/0583* (2013.01)

(58) Field of Classification Search
CPC ..... A45F 5/10; A45F 3/16; A45F 2005/1013; A45F 2200/0583
USPC ..... 220/710.5
See application file for complete search history.

(56) References Cited

U.S. PATENT DOCUMENTS 980,193 A * 1/1911 Brenia ..... A47B 95/02 16/419
3,158,284 A * 11/1964 Henchert ..... B65D 51/242 220/768
3,514,820 A * 6/1970 Rogg ..... A44B 99/005 24/DIG. 58
8,561,835 B2 * 10/2013 Hansen ..... A47J 45/074 220/573.1
2008/0099424 A1 * 5/2008 Chalekian ..... B65D 47/08 215/396
2008/0245763 A1 * 10/2008 Chalekian ..... B65D 51/242 215/396
2010/0187247 A1 * 7/2010 Ziegler ..... B65D 43/0208 220/737

(Continued)

FOREIGN PATENT DOCUMENTS

CN 105923252 A * 9/2016 ..... B65D 47/0895
CN 106263963 A * 1/2017 ..... A47G 19/22

OTHER PUBLICATIONS

English translation of CN 105923252 A (Year: 2016).*

*Primary Examiner* — Don M Anderson
*Assistant Examiner* — Eric C Baldrighi
(74) *Attorney, Agent, or Firm* — Randall Danskin, P.S.

(57) ABSTRACT

A drinkware apparatus includes a liquid container with a reservoir therein, the liquid container having an exterior surface, and a dispensing lid that engages with the liquid container, the dispensing lid having an exterior surface. A pair of hinge lugs extend outwardly from the exterior surface of the liquid container or outwardly from the exterior surface of the dispensing lid, each of the hinge lugs having a mounting surface that opposes the mounting surface of the other hinge lug. Each of a pair of opposing hinge posts extends from the mounting surface of a respective one of the hinge lugs and is positioned between the hinge lugs. A carrying arm is rotatable about the hinge posts when mounted thereon. The carrying arm is selectively removable from and selectively remountable on the hinge posts without adjustment of the hinge posts, hinge lugs, dispensing lid, or liquid container.

23 Claims, 7 Drawing Sheets

(56) References Cited

U.S. PATENT DOCUMENTS

| | | | | |
|---|---|---|---|---|
| 2010/0224631 | A1* | 9/2010 | Roth | B65D 45/025 220/288 |
| 2011/0247994 | A1* | 10/2011 | Siciliano | B65D 23/12 215/395 |
| 2012/0132681 | A1* | 5/2012 | Valaas | A43B 5/0425 224/191 |
| 2017/0253394 | A1* | 9/2017 | Fogarty | B65D 47/065 |
| 2021/0171248 | A1* | 6/2021 | Hawes | B65D 47/0847 |
| 2022/0297899 | A1* | 9/2022 | Raymus | B65D 51/18 |

* cited by examiner

DRINKWARE APPARATUS

BACKGROUND

Personal, liquid-dispensing containers, often referred to generally as "drinkware," may include an additional cover or lid. Various types of such containers with lids have been fabricated and sold over many decades. In the present day, such devices are often referred to generically as "water bottles," though they frequently contain liquids other than water, or simply "bottles." For many years, these personal, liquid-dispensing containers and their associated covers or lids, or water bottles, have been designed to meet the particular needs of users during their various events and activities. Water bottles have been designed to increase ease of transport between uses relying on a number of different handles, grips, shapes, clips, etc.

At times, designs to increase the ease of transport nevertheless render the water bottle more cumbersome in handling, cleaning, and storage. With more complex structures to meet users' needs often comes new disadvantages. Accordingly, designs that add features to increase the ease of transport without affecting handling, cleaning, and storage would be beneficial.

BRIEF DESCRIPTION OF THE DRAWINGS

Some embodiments are described below with reference to the following accompanying drawings.

DETAILED DESCRIPTION

Figure 1:
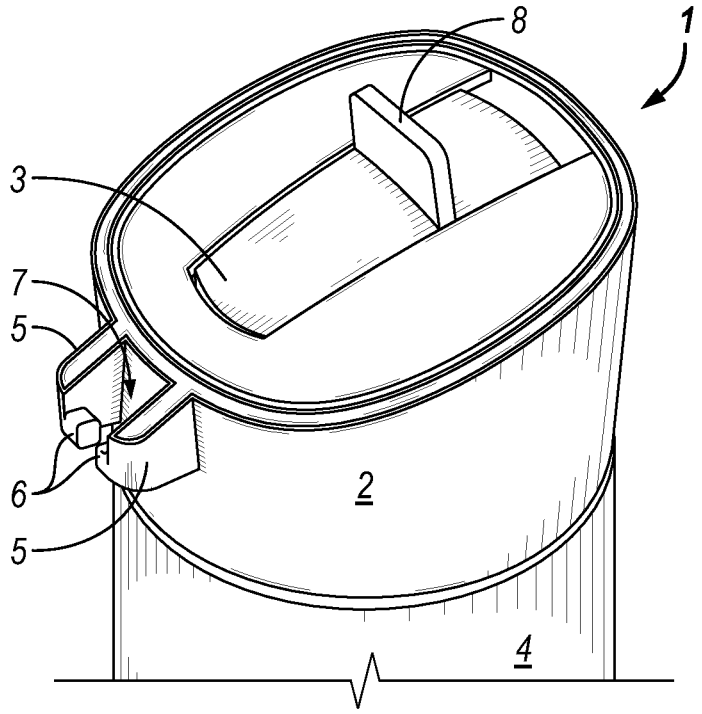
FIG. 1 is a perspective view of a liquid container and a dispensing lid according to one implementation of a drinkware apparatus.

The example implementations described herein refer to the accompanying drawings. The same reference numerals in the various drawings may identify the same or similar features.

In some instances, drinkware, such as water bottles, may include a handle or clip intended to increase ease of transport between uses. Handles generally accommodate a user manually carrying the drinkware, while clips generally accommodate attaching drinkware to an article, such as a backpack. Some devices include the features of a handle accommodating manual carrying as well as the features of a clip accommodating attachment to an article. Flexibility of use is often a benefit.

The term "carrying arms" refers generally to handles, clips, and other structures. Some carrying arms are fixed in position while others may be rotated into a variety of positions. Very often, carrying arms may not be removed from drinkware, or at least are not readily removed without adjustment, such as disassembly, of the drinkware to permit removal. The inability to remove selectively a carrying arm may present a disadvantage when attempting to clean drinkware, especially in a dishwasher. An attached carrying arm could make positioning drinkware in a dishwasher quite cumbersome.

Drinkware may be stowed in other articles, such as in a backpack pocket, or placed in a storage space when not being used. A carrying arm that cannot be removed without adjustment of the drinkware components may encumber the drinkware when attempting to store it in a small space or pocket.

Known carrying arms, whether fixed to the drinkware or removable, generally offer a single size and shape for a particular item of drinkware. If a user desires different sizes and/or shapes of carrying arms for different uses, then the user may generally possess different drinkware for each type of use. Consequently, the size and shape of a carrying arm could be a limiting characteristic that necessitates ownership of multiple drinkware to accommodate multiple purposes.

Some implementations described herein provide a pair of hinge lugs extending outwardly from an exterior surface of a liquid container or outwardly from an exterior surface of a dispensing lid. A pair of opposing hinge posts is on and between the hinge lugs. Such a drinkware apparatus permits the use of a carrying arm that is rotatable about the hinge posts when mounted thereon. The carrying arm may also be selectively removable from and remountable on the hinge posts without adjustment of the hinge posts, hinge lugs, dispensing lid, or liquid container. Although the carrying arm is "adjusted" in the sense that it is removed from and remounted on the hinge posts, the removal and remounting may occur without changing a structural configuration of the carrying arm other than its mounting on the hinge posts. That is, for example, removal and remounting need not involve adjusting the position of a clip, catch, gate, or other retaining structure on the carrying arm.

Therefore, some implementations described herein allow the position of a carrying arm to be flexible. That is, the carrying arm may be in an upward position for instances when the drinkware is being carried or in downward positions when the drinkware is set aside. The position of the carrying arm may further be flexible in that the position may be secured, in which the carrying arm does not freely rotate out of the position, or the position may be free, permitting rotation. Also, some implementations permit removal of the carrying arm for purposes in which retention of the carrying arm may be cumbersome, such as cleaning or storage. Further, some implementations described herein permit exchanging different sizes and/or shapes of carrying arms on the same drinkware to accommodate different purposes during users' various activities and events with the same container and lid.

The discoveries described herein identify a number of solutions that may be implemented in devices and methods also described herein. Multiple solutions may be combined for implementation, enabling still further devices and methods. The inventors expressly contemplate that the various options described herein for individual devices and methods are not intended to be so limited except where incompatible with other devices and methods. The features and benefits of individual devices herein may also be used in combination with methods and other devices described herein even though not specifically indicated elsewhere. Similarly, the features and benefits of individual methods herein may also be used in combination with devices and other methods described herein even though not specifically indicated elsewhere.

Device A is a drinkware apparatus including a liquid container with a reservoir therein, the liquid container having an exterior surface, and a dispensing lid that engages with the liquid container, the dispensing lid having an exterior surface. A pair of hinge lugs extend outwardly from the exterior surface of the liquid container or outwardly from the exterior surface of the dispensing lid, each of the hinge lugs having a mounting surface that opposes the mounting surface of the other hinge lug. Each of a pair of opposing hinge posts extends from the mounting surface of a respective one of the hinge lugs and is positioned between the hinge lugs. A carrying arm is rotatable about the hinge posts when mounted thereon. The carrying arm is selectively removable from and selectively remountable on the hinge posts without adjustment of the hinge posts, hinge lugs, dispensing lid, or liquid container.

Additional features may be implemented in Device A. By way of example, the dispensing lid may include a spout through which liquid can be selectively removed from the liquid container through the dispensing lid while the dispensing lid is engaged with the liquid container. The dispensing lid may releasably engage with the liquid container and, thereby, selectively seal the reservoir when engaged with the liquid container. The engagement may be threaded or another type of known engagement. The hinge lugs may be on the dispensing lid.

The carrying arm may be rotatable approximately 180° or more about the hinge posts when mounted thereon. The carrying arm may be selectively removable from and selectively remountable on the hinge posts without changing a structural configuration of the carrying arm other than its mounting on the hinge posts.

The hinge posts may be positioned on the hinge lugs with a gap between the hinge posts and the liquid container or the dispensing lid. At least a part of the carrying arm may pass through the gap when the carrying arm rotates about the hinge posts when mounted thereon. The hinge posts may be offset from a central portion of the hinge lugs at a lower portion of the hinge lugs in order to provide the gap.

The carrying arm may include a collar and a handle connected to the collar. The collar may be rotatable about the hinge posts when mounted thereon, the collar being selectively removable from and selectively remountable on the hinge posts without adjustment of the hinge posts, hinge lugs, dispensing lid, or liquid container. The collar may fit between the hinge posts during the selective mounting thereon. At least a part of the collar may pass through the gap when the collar rotates about the hinge posts when mounted thereon.

The collar may include one or more slot that corresponds to one or more of the hinge posts. In that circumstance, the one or more of the hinge posts may pass through the corresponding slot when removing and remounting the collar on the hinge posts. Additionally, the collar may include a pair of opposing slots that align with the pair of opposing hinge posts. In that circumstance, each of the hinge posts may pass through the corresponding slot when removing and remounting the collar on the hinge posts.

The collar may include an elongate loop with a first longitudinal end free to rotate about the hinge posts and an opposing second longitudinal end connected to the handle. The collar can slide through the gap into one or more secured position in which the collar is not rotatable when the second end engages the hinge posts. The first longitudinal end may be rounded.

In one implementation, the handle may include a loop separate from the collar, the loop and the collar being adjacent, having a border in common.

In another implementation, the handle may include a loop separate from the collar, the loop and the collar not being adjacent, not having a border in common, and the loop being connected to the collar with a shank.

In a further implementation, the handle may include a tee separate from the collar, the tee and the collar not being adjacent, not having a border in common, and the tee being connected to the collar with a shank.

In a still further implementation, the collar may include a portion of a loop and the handle may include another portion of the same loop.

The drinkware apparatus may include multiple different carrying arms in a kit permitting a user to select one of the carrying arms to accommodate a selected activity or event with the same container and lid.

The described additional features of Device A may also be implemented in other devices and methods herein.

Device B is a drinkware apparatus including a liquid container with a reservoir therein, the liquid container having an exterior surface, and a dispensing lid that engages with the liquid container, the dispensing lid having an exterior surface. The dispensing lid includes a spout through which liquid can be selectively removed from the liquid container through the dispensing lid while the dispensing lid is engaged with the liquid container. The dispensing lid releasably engages with the liquid container and, thereby, selectively seals the reservoir when engaged with the liquid container. A pair of hinge lugs extend outwardly from the exterior surface of the dispensing lid, each of the hinge lugs having a mounting surface that opposes the mounting surface of the other hinge lug. Each of a pair of opposing hinge posts extends from the mounting surface of a respective one of the hinge lugs and is positioned between the hinge lugs. A carrying arm is rotatable about the hinge posts when mounted thereon. The carrying arm is selectively removable from and selectively remountable on the hinge posts without adjustment of the hinge posts, hinge lugs, dispensing lid, or liquid container.

Additional features may be implemented in Device B. By way of example, the hinge posts may be positioned on the hinge lugs with a gap between the hinge posts and the dispensing lid. At least a part of the carrying arm may pass through the gap when the carrying arm rotates about the hinge posts when mounted thereon.

The carrying arm may include a collar and a handle connected to the collar. The collar may be rotatable about the hinge posts when mounted thereon, the collar being selectively removable from and selectively remountable on the hinge posts without adjustment of the hinge posts, hinge lugs, dispensing lid, or liquid container. The collar may fit between the hinge posts during the selective mounting thereon. At least a part of the collar may pass through the gap when the collar rotates about the hinge posts when mounted thereon.

The described additional features of Device B may also be implemented in other devices and methods herein.

Device C is a drinkware apparatus including a liquid container with a reservoir therein, the liquid container having an exterior surface, and a dispensing lid that engages with the liquid container, the dispensing lid having an exterior surface. A pair of hinge lugs extend outwardly from the exterior surface of the liquid container or outwardly from the exterior surface of the dispensing lid, each of the hinge lugs having a mounting surface that opposes the mounting surface of the other hinge lug. Each of a pair of opposing hinge posts extends from the mounting surface of a respective one of the hinge lugs and is positioned between the hinge lugs. The hinge posts are positioned on the hinge lugs with a gap between the hinge posts and the dispensing lid. A carrying arm includes a collar that is rotatable about the hinge posts when mounted thereon and a handle connected to the collar. The collar is selectively removable from and selectively remountable on the hinge posts without adjustment of the hinge posts, hinge lugs, dispensing lid, or liquid container. The collar fits between the hinge posts during the selective mounting thereon. At least a part of the collar passes through the gap when the collar rotates about the hinge posts when mounted thereon.

Additional features may be implemented in Device C.

Figure 2:
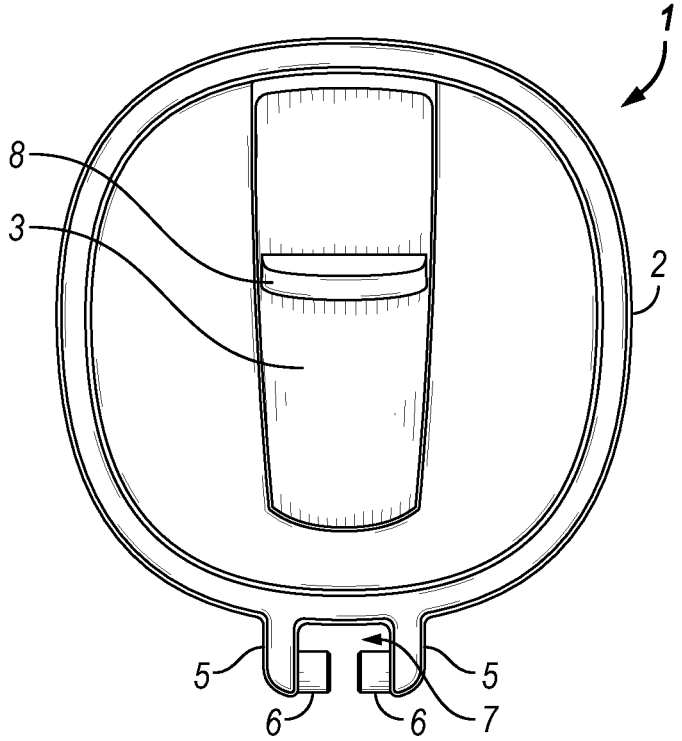
FIG. 2 is a top view of the dispensing lid in FIG. 1.

The accompanying drawings provide some examples of Devices A-C. FIGS. 1 and 2 show a portion of a drinkware apparatus 1 without a carrying arm installed. Apparatus 1 includes a dispensing lid 2 engaged with a liquid container 4. In the implementation of FIGS. 1 and 2, dispensing lid 2 includes a spout 3 through which liquid may be selectively removed from liquid container 4 through dispensing lid 2. Spout 3 includes a tab 8 permitting a user to grip tab 8 and rotate spout 3 into a dispensing position (shown in FIG. 4D).

Although not apparent from FIGS. 1 and 2, dispensing lid 2 releasably engages with liquid container 4 and, thereby, selectively seals a reservoir (not shown) therein when engaged with liquid container 4. The engagement with liquid container 4 may be a threaded engagement or other known type of releasable engagement.

Apparatus 1 includes a pair of hinge lugs 5 extending outwardly from the exterior surface of dispensing lid 2. A pair of opposing hinge posts 6 extend from hinge lugs 5 and are positioned between hinge lugs 5. In the implementation of FIGS. 1 and 2, hinge posts 6 are positioned on hinge lugs 5 with a gap 7 between hinge posts 6 and dispensing lid 2. In addition, in the implementation of FIGS. 1 and 2, hinge posts 6 are offset from a central portion of hinge lugs 5 at a lower portion of hinge lugs 5.

As shown in FIGS. 3A-D and 4A-D, at least a part of a carrying arm may pass through gap 7 when the carrying arm rotates about hinge posts 6 when mounted thereon. Also, in FIGS. 3A-D, the carrying arms are selectively removable from and selectively remountable on hinge posts 6 without adjustment of hinge posts 6, hinge lugs 5, dispensing lid 2, or liquid container 4. Further, in FIGS. 3A-D, the carrying arms are selectively removable from and selectively remountable on the hinge posts without changing a structural configuration of the carrying arm other than its mounting on the hinge posts.

Still further, in FIGS. 3A-D, it will be appreciated from the discussion herein that the carrying arm is rotatable approximately 180° or more about hinge posts 6. In the present document, "approximately 180°" refers to the carrying arm's ability to rotate about the hinge posts into two generally diametric or generally opposite positions. For example, a lower, generally downward position may be approximately 180° from an upper, generally upward position even if by geometric measurement they are not exactly 180° apart.

Figure 3B:
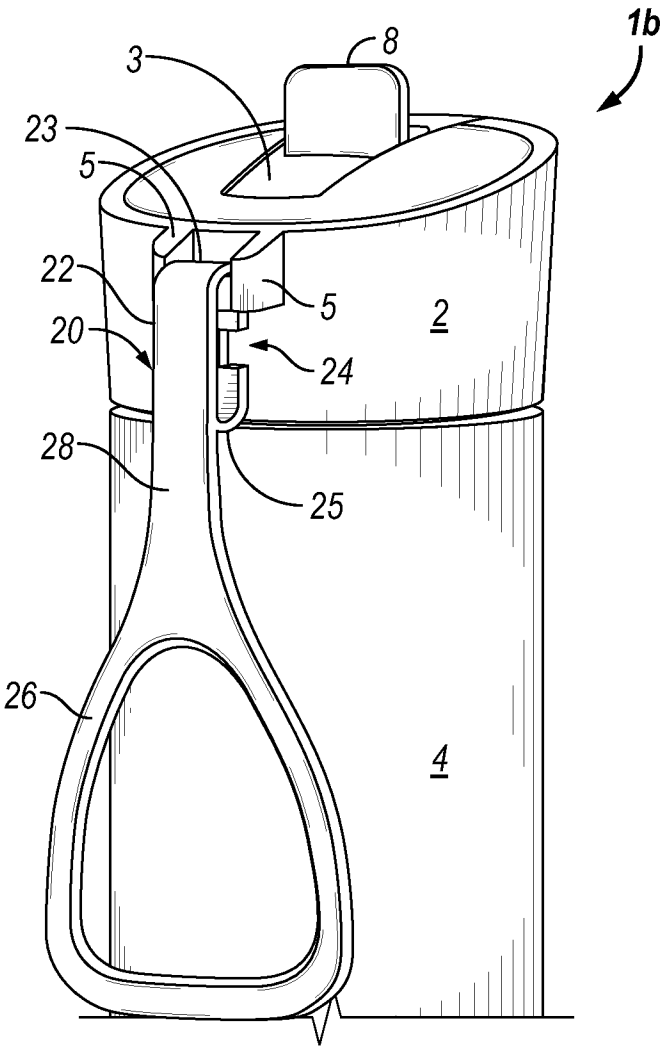
FIGS. 3A-D are perspective views of the FIG. 1 liquid container and dispensing lid with four implementations of carrying arms.
Figure 3A:
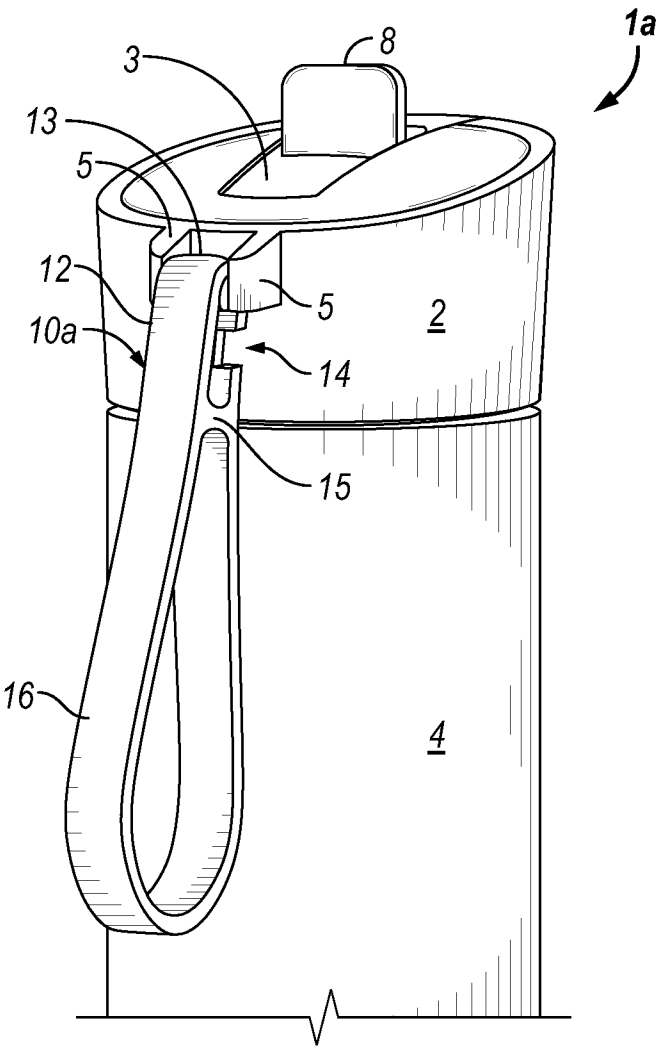

FIG. 3A shows a drinkware apparatus 1*a* with a carrying arm 10*a* mounted on hinge posts 6. Carrying arm 10*a* may be termed a "lanyard" style of carrying arm. Carrying arm 10*a* includes a collar 12 and a handle 16 connected to collar 12. Collar 12 is rotatable about hinge posts 6 and selectively removable from and selectively remountable on hinge posts 6. At least a part of collar 12 passes through gap 7 when collar 12 rotates about hinge posts 6. Collar 12 includes a pair of opposing slots 14 that align with hinge posts 6. Each of hinge posts 6 passes through a corresponding slot 14 when removing and remounting collar 12 on hinge posts 6.

In the implementation of FIG. 3A, collar 12 is formed as an elongate loop with a first longitudinal end 13 free to rotate about hinge posts 6 and an opposing second longitudinal end 15 connected to handle 16. In the implementation of FIG. 3A, handle 16 is also formed as a loop. The loop of handle 16 is separate from collar 12, although the loop and collar 12 are adjacent, having a border in common.

It will be appreciated that collar 12 and the loop of handle 16 each define a plane. It will also be appreciated that the plane of collar 12 and the plane of the loop of handle 16 are parallel. Indeed, in the implementation of FIG. 3A, the plane of collar 12 and the plane of the loop of handle 16 are coplanar.

Also, FIG. 3A shows first end 13 as rounded. "Rounded", as the term is used herein, refers to an object that is convex, curving, or round in shape, that is, flowing rather than jagged or angular. First end 13 being rounded facilitates rotation of collar 12 about hinge posts 6. More specifically, first end 13 is shown as oval. "Oval", as the term is used herein, refers to having a broadly elliptical shape. First end 13 being oval may further facilitate rotation of first end 13 about hinge posts 6.

Second end 15 could be rounded, such as oval, as for first end 13, but may also be squared or some other shape. The shape of second end 15 may complement a shape of hinge posts 6 to engage more positively therewith when in a secured position, as described in further detail below. That is, if hinge posts 6 are squared, then second end 15 may be likewise squared to engage more positively. Instead, if hinge posts 6 are rounded, then second end 15 may be likewise rounded to engage more positively.

FIG. 3B shows a drinkware apparatus 1*b* with a carrying arm 20 mounted on hinge posts 6. Carrying arm 20 may be termed a "loop handle" style of carrying arm. Carrying arm 20 includes a collar 22 and a handle 26 connected to collar 22. Collar 22 is rotatable about hinge posts 6 and selectively removable from and selectively remountable on hinge posts 6. At least a part of collar 22 passes through gap 7 when collar 22 rotates about hinge posts 6. Collar 22 includes a pair of opposing slots 24 that align with hinge posts 6. Each of hinge posts 6 passes through a corresponding slot 24 when removing and remounting collar 22 on hinge posts 6.

In the implementation of FIG. 3B, collar 22 is formed as an elongate loop with a first longitudinal end 23 free to rotate about hinge posts 6 and an opposing second longitudinal end 25 connected to handle 26. In the implementation of FIG. 3B handle 26 is also formed to include a loop. The loop of handle 26 is separate from collar 22, the loop and collar 22 are not adjacent, not having a border in common, and the loop of handle 26 is connected to collar 22 with a shank 28.

It will be appreciated that collar 22 and the loop of handle 26 each define a plane. It will also be appreciated that the plane of collar 22 and the plane of the loop of handle 26 are not parallel. Indeed, in the implementation of FIG. 3B, the plane of collar 22 and the plane of the loop of handle 26 are orthogonal.

Also, FIG. 3B shows first end 23 as rounded. First end 13 being rounded facilitates rotation of collar 22 about hinge posts 6. More specifically, first end 23 is shown as oval. First end 23 being oval may further facilitate rotation of first end 23 about hinge posts 6.

Second end 25 could be rounded, such as oval, as for first end 23, but may also be squared or some other shape. The shape of second end 25 may complement a shape of hinge posts 6 to engage more positively therewith when in a secured position, as described in further detail below. That is, if hinge posts 6 are squared, then second end 25 may be likewise squared to engage more positively. Instead, if hinge posts 6 are rounded, then second end 25 may be likewise rounded to engage more positively.

Figure 3D:
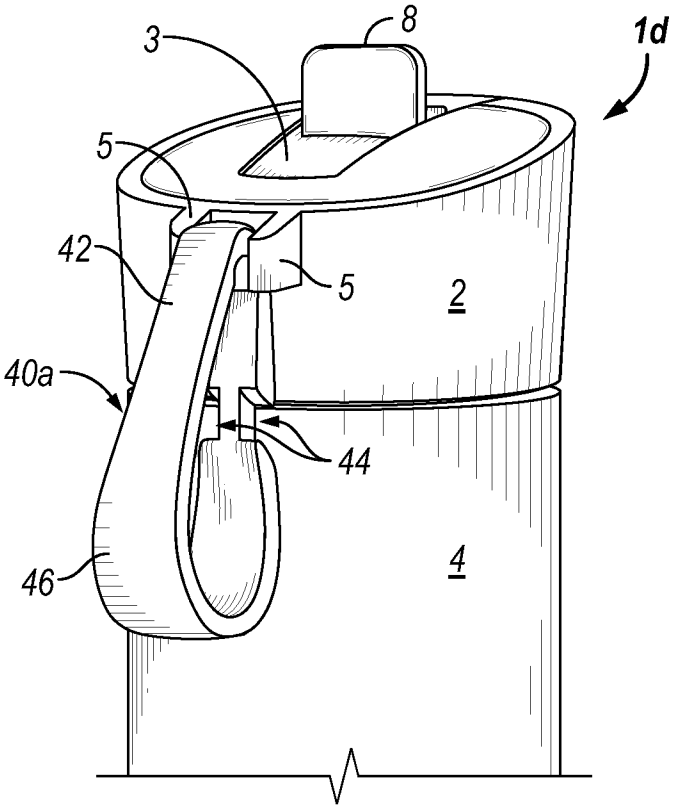
Figure 3C:
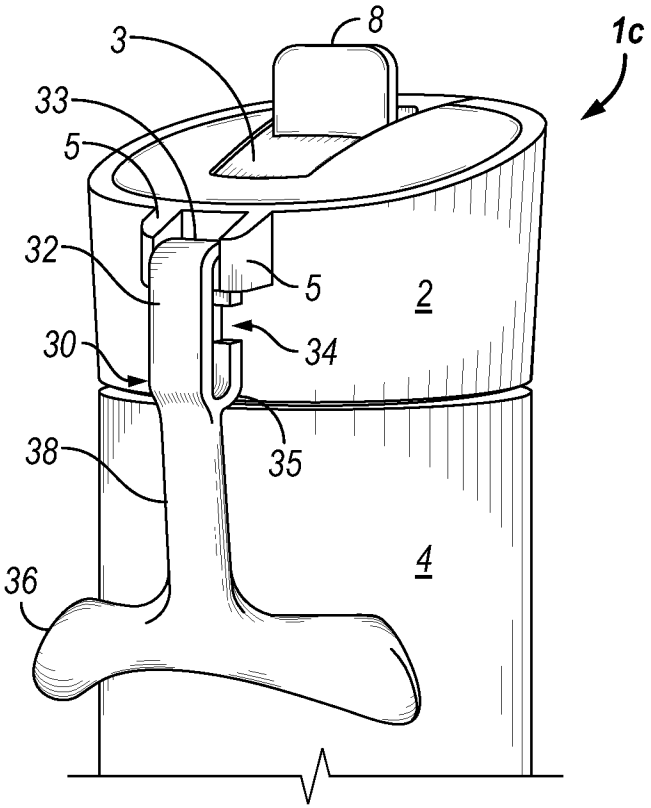

FIG. 3C shows a drinkware apparatus 1*c* with a carrying arm 30 mounted on hinge posts 6. Carrying arm 30 may be termed a "tee handle" style of carrying arm. Carrying arm 30 includes a collar 32 and a handle 36 connected to collar 22. Collar 22 is rotatable about hinge posts 6 and selectively removable from and selectively remountable on hinge posts 6. At least a part of collar 32 passes through gap 7 when collar 32 rotates about hinge posts 6. Collar 32 includes a pair of opposing slots 34 that align with hinge posts 6. Each of hinge posts 6 passes through a corresponding slot 34 when removing and remounting collar 32 on hinge posts 6.

In the implementation of FIG. 3C, collar 32 is formed as an elongate loop with a first longitudinal end 33 free to rotate about hinge posts 6 and an opposing second longitudinal end 35 connected to handle 36. In the implementation of FIG. 3C, handle 36 is formed to include a tee. The tee of handle 36 is separate from collar 32, the tee and collar 32 are not adjacent, not having a border in common, and the tee of handle 36 is connected to collar 32 with a shank 38. It will be appreciated that shank 38 and the tee of handle 16 are orthogonal.

Also, FIG. 3C shows first end 33 as rounded. First end 33 being rounded facilitates rotation of collar 32 about hinge posts 6. More specifically, first end 33 is shown as oval. First end 33 being oval may further facilitate rotation of first end 33 about hinge posts 6.

Second end 35 could be rounded, such as oval, as for first end 33, but may also be squared or some other shape. The shape of second end 35 may complement a shape of hinge posts 6 to engage more positively therewith when in a secured position, as described in further detail below. That is, if hinge posts 6 are squared, then second end 35 may be likewise squared to engage more positively. Instead, if hinge posts 6 are rounded, then second end 35 may be likewise rounded to engage more positively.

FIG. 3D shows a drinkware apparatus 1*d* with a carrying arm 40*a* mounted on hinge posts 6. Carrying arm 40*a* may be termed a "ring loop" style of carrying arm. Carrying arm 40*a* includes a collar 42 and a handle 46 connected to collar 42. Collar 42 is rotatable about hinge posts 6 and selectively removable from and selectively remountable on hinge posts 6. At least a part of collar 42 passes through gap 7 when collar 42 rotates about hinge posts 6. Collar 42 includes a pair of opposing slots 44 that align with hinge posts 6. Each of hinge posts 6 passes through a corresponding slot 44 when removing and remounting collar 42 on hinge posts 6.

In the implementation of FIG. 3D, collar 42 is formed as a portion of a loop and handle 46 is formed as another portion of the same loop. Also, in FIG. 3D, a part of collar 42 is shown as rounded. Collar 42 being rounded facilitates rotation of collar 42 about hinge posts 6. More specifically, a part of collar 42 is shown as oval. Collar 42 being oval may further facilitate rotation of collar 42 about hinge posts 6.

Figure 4B:
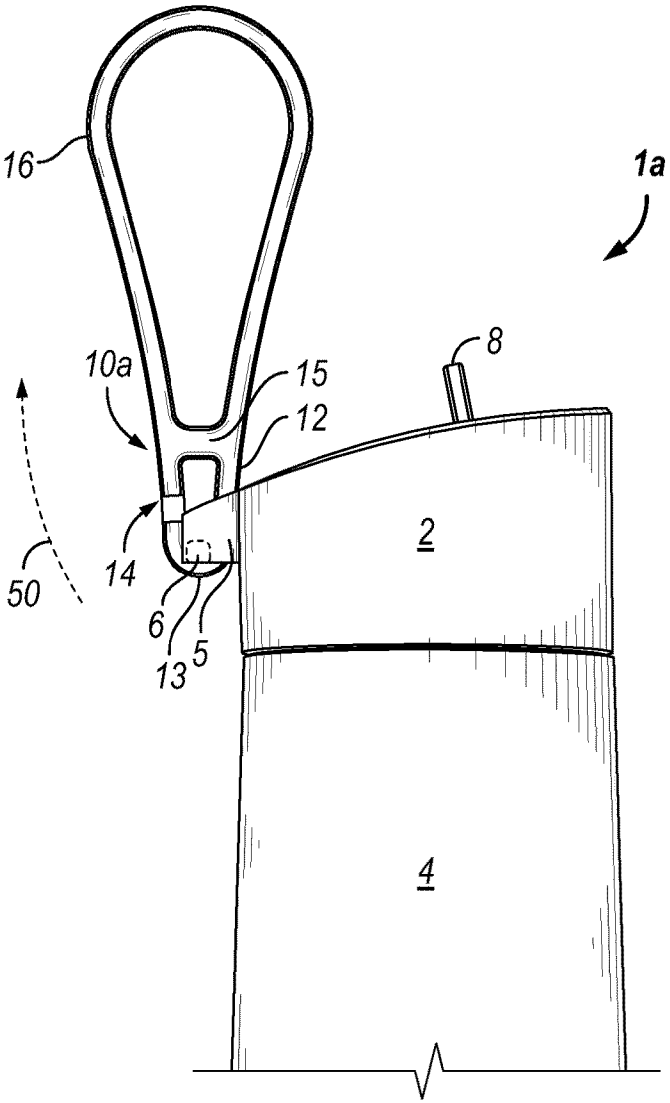
FIGS. 4A-D are side views of the drinkware apparatus in FIG. 3A showing the carrying arm in various positions and the dispensing lid and liquid container in two orientations.
Figure 4A:
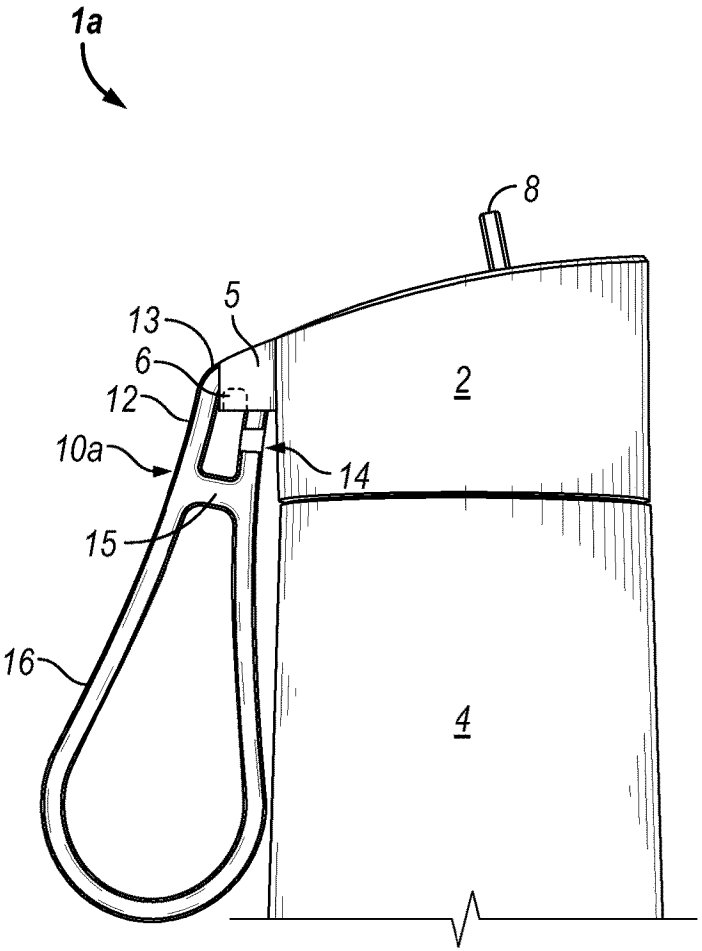

FIGS. 4A-D show a sequence of positions for carrying arm 10*a* and a series of orientations for apparatus 1*a* as an example of transitioning between positions wherein first end 13 is free to rotate about hinge posts 6 and secured positions in which collar 12 is not rotatable when second end 15 engages hinge posts 6. FIGS. 4A and 4B show carrying arm 10*a* rotating in the direction shown by an arrow 50 from a down position to an up position. In the down position of FIG. 4A and the up position of FIG. 4B, carrying arm 10*a* is free to rotate about hinge posts 6.

Figure 4D:
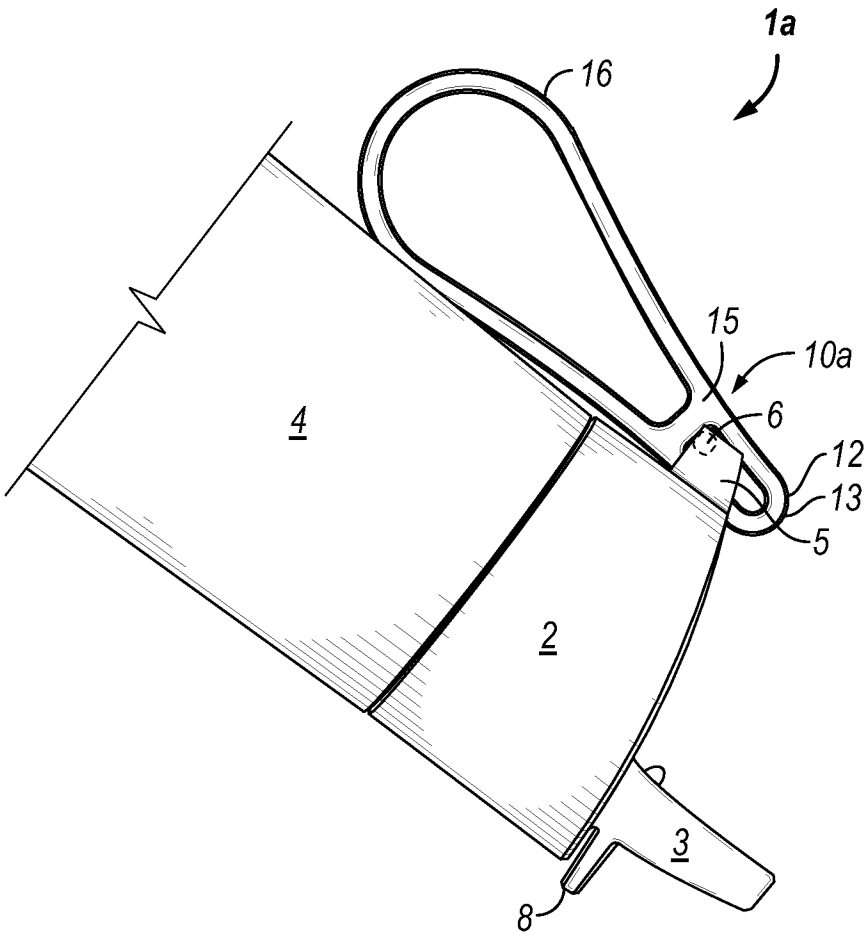
Figure 4C:
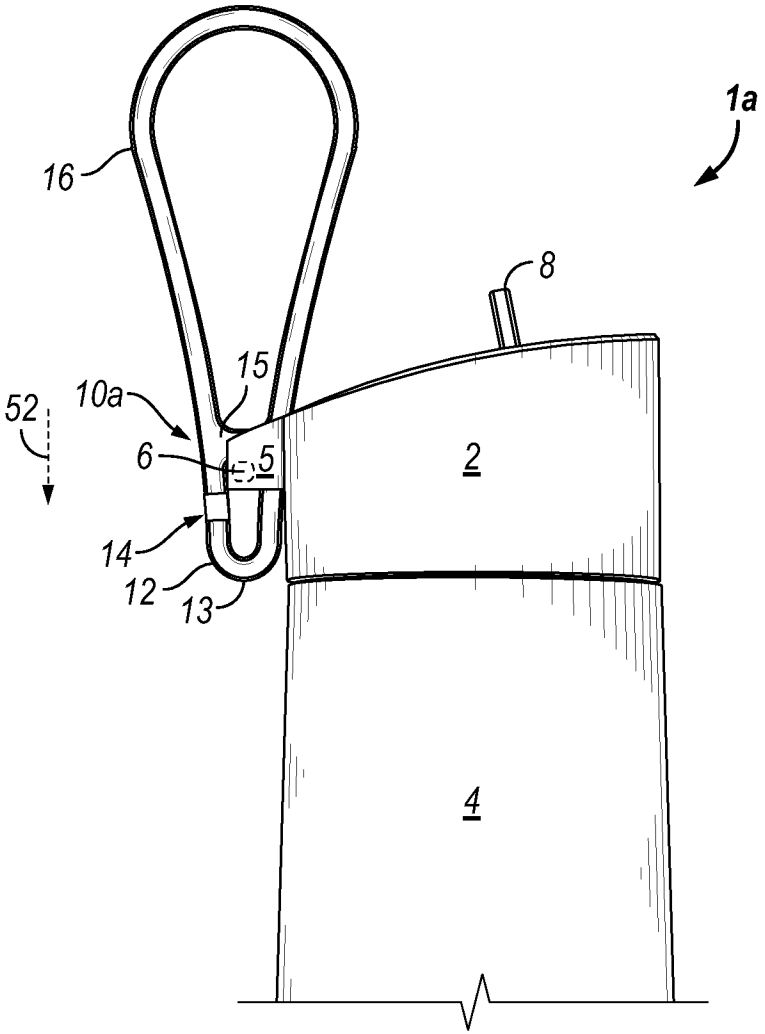

A user may rotate carrying arm 10*a* to the up position in order to place carrying arm 10*a* in a secured position shown in FIG. 4C. The secured position of FIG. 4C is reached by allowing carrying arm 10*a* to slide along the direction shown by an arrow 52 until second end 15 engages hinge posts 6. Since collar 12 is formed as an elongate loop, it will be appreciated that an attempt to rotate carrying arm 10*a* from the secured position of FIG. 4C to the down position of FIG. 4A may be prevented by collar 12 abutting dispensing lid 2.

Likewise, given the spacing of gap 7 between hinge posts 6 and dispensing lid 2, carrying arm 10*a* in the secured position of FIG. 4C abuts dispensing lid 2 above hinge posts 6 and may not rotate toward tab 8. This inability results from the position selected for hinge posts 6 to provide an axis of rotation for carrying arm 10*a* that is below the top edge of dispensing lid 2 directly above hinge posts 6. Since the axis of rotation is below the top edge of dispensing lid 2, rotation may be prevented.

The secured position of FIG. 4C is quite convenient. When apparatus 1*a* is placed at rest with carrying arm 10*a* in the secured position of FIG. 4C, a user may quickly grasp handle 16 in the readily available up position and easily transport apparatus 1*a*.

FIG. 4D shows a secured position that transitioned from the free position shown in FIG. 4A. Upon manipulating tab 8 to extend spout 3 into a dispensing position, a user may rotate apparatus 1*a* to obtain liquid from spout 3. Noticeably, carrying arm 10*a* may then simply slide into the secured position of FIG. 4D where second end 15 engages hinge posts 6. In the secured position of FIG. 4D, the elongate loop that forms collar 12 does not allow carrying arm 10*a* to rotate into the face of a user drinking from spout 3. That is because collar 12 abuts the portion of dispensing lid 2 that would be considered directly above hinge posts 6 when apparatus 1*a* is in the upright position of FIG. 4A.

Consequently, the positioning of carrying arm 10*a* is flexible in that it may be up or down, secured or free. Flexibility of position affords flexibility of use. Similar flexibility of position is afforded by collar 22 of carrying arm 20 and collar 32 of carrying arm 30, both including an elongate loop with first and second longitudinal ends.

Carrying arm 40*a* of apparatus 1*d* does not include an elongate loop such that collar 42 may slide through gap 7 into a secured position when a second longitudinal end engages hinges posts 6. However, handle 46 of carrying arm 40*a* has a greater width in comparison to collar 42. Accordingly, upon rotating carrying arm 40*a* into the position shown in FIG. 4B, collar 42 may slide through gap 7 until the greater width of handle 46 wedges between hinge lugs 5. Once wedged between hinge lugs 5, collar 42 may be in a secured position with handle 46 of carrying arm 40*a* extending above dispensing lid 2 and readily available for quick grasping by a user. In a similar manner, carrying arm 40*a* may slide forward to a secured position similar of that shown in FIG. 4D upon rotating apparatus 1*d* into a position for withdrawing liquid from spout 3.

Figure 5:
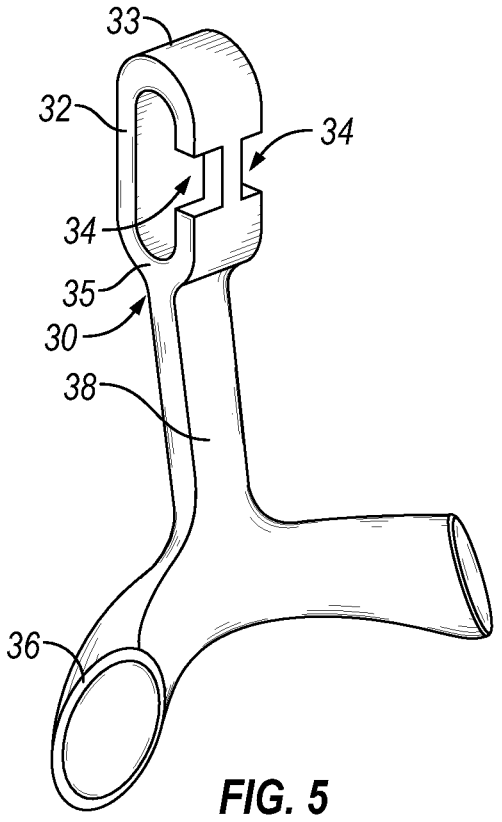
FIG. 5 is a different perspective view of the carrying arm shown in FIG. 3C.

FIG. 5 shows a perspective view of carrying arm 30 detached from apparatus 1*c* and revealing more detail of slots 34. Similar slots are provided on carrying arm 10*a* for slots 14 and on carrying arm 20 for slots 24. Also apparent from FIG. 5 is the curved nature of handle 36 with a curvature similar to the exterior surface of liquid container 4. In such manner, handle 36 substantially conforms to liquid container 4. Handle 26 of carrying arm 20 may likewise have a curvature similar to the exterior surface of liquid container 4 so that it substantially conforms to liquid container 4.

Since slots 34 are positioned on an inner side of collar 32 facing dispensing lid 2 when carrying arm 30 is in a down position, like FIG. 4A, the rotation of carrying arm 30 outwardly about first end 33 rotates slots 34 away from hinge posts 6. Accordingly, when collar 32 slides through gap 7 into a secured position, like FIG. 4C, collar 32 does not slip out of engagement with hinge posts 6 through slots 34. Also, slots 34 are positioned between first end 33 and second end 35. Consequently, when carrying arm 30 slides forward from the down position in FIG. 4A to the secured position of FIG. 4D with apparatus 1*c* in a rotated dispensing orientation, collar 32 slides through gap 7 without disengagement en route to engagement of hinge posts 6 with second end 35.

Figure 6:
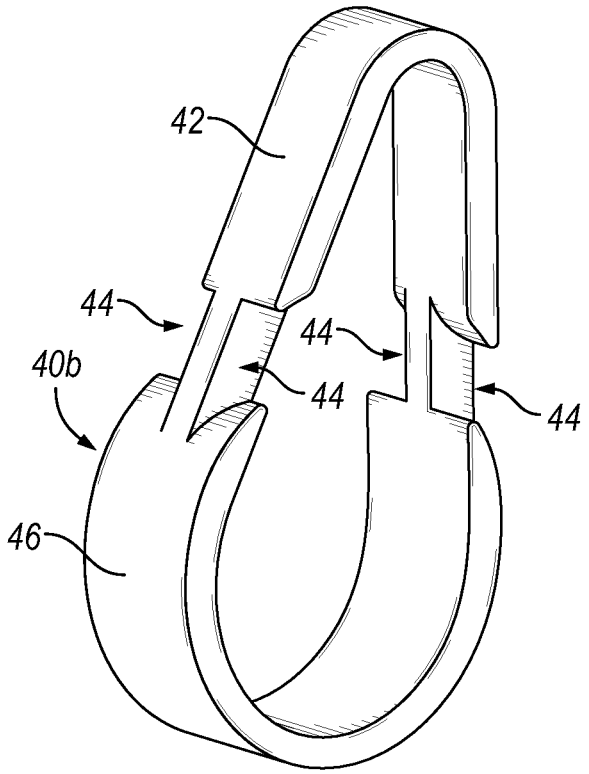
FIG. 6 is an alternative implementation of a carrying arm similar to that shown in FIG. 3D.

FIG. 6 shows an alternative carrying arm 40*b* similar in all respects to carrying arm 40*a* except that an additional pair of opposing slots 44 is provided. The function of carrying arm 40*b* is the same as that expressed herein for carrying arm 40*a* except that an additional area of disengagement is provided.

Figure 7A:
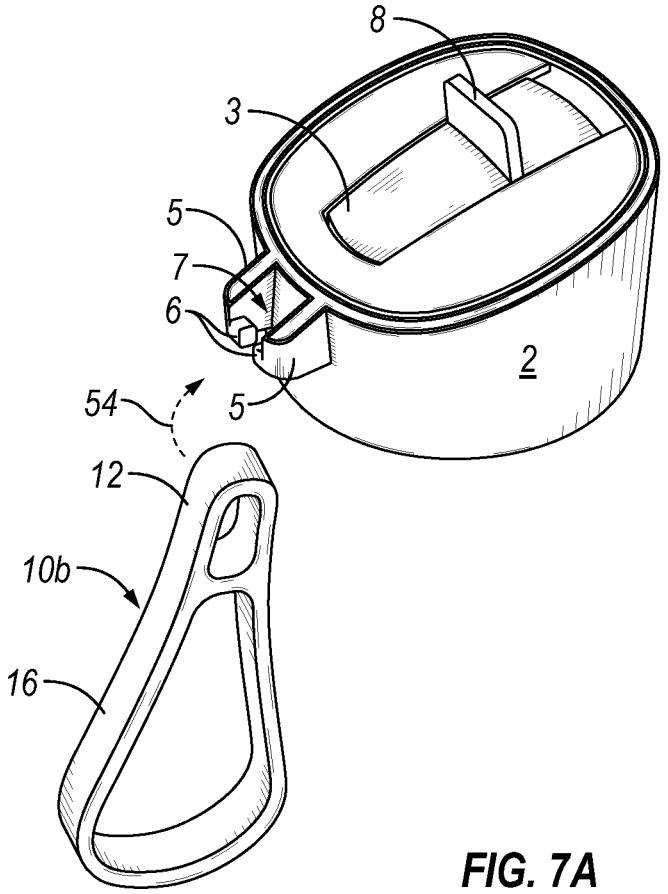
FIGS. 7A-B show perspective views of the dispensing lid in FIGS. 1 and 2 with an alternative implementation of a carrying arm similar to that shown in FIG. 3A at successive stages of mounting the carrying arm.
Figure 7B:
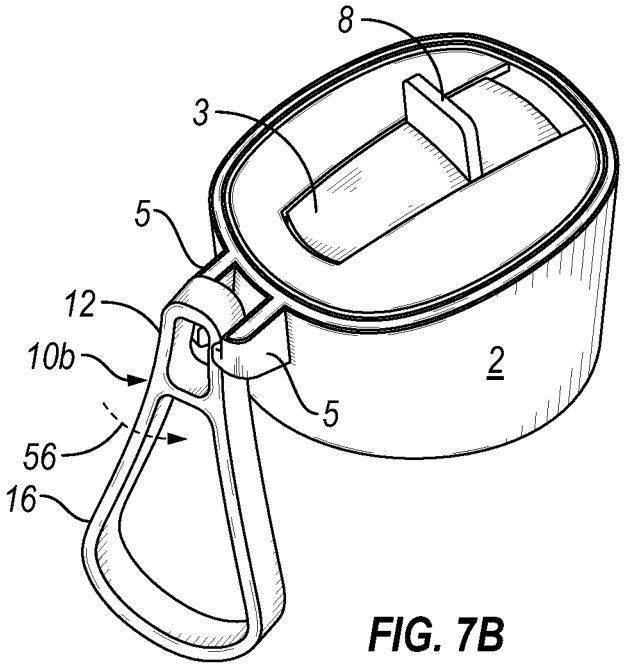

FIGS. 7A-B show an alternative carrying arm 10*b* the same as carrying arm 10*a* except that no slots 14 are provided. FIG. 7A-B, however, show an example of how a suitably sized and shaped combination of hinge lugs 5, hinge posts 6, gap 7, and collar 12 may be relied upon to selectively remove from and selectively remount on hinge posts 6. In FIG. 7A, carrying arm 10*b* may move along the direction of an arrow 54 placing one side of collar 12 between hinge posts 6 into the position shown in FIG. 7B. From FIG. 7B, collar 12 may be rotated along the direction shown by an arrow 56 into the position of carrying arm 10*a* shown in FIG. 3A.

Once mounted on hinge posts 6, the function of carrying arm 10*b* is the same as that discussed herein for carrying arm 10*a* with the exception of removal from hinge posts 6. Removal may be conducted simply by reversing the steps shown in FIGS. 7A-B. Although technically possible to size the relevant structures of dispensing lid 2 and carrying arm 10*b* for selectively removing and selectively remounting carrying arm 10*b* without slots 14, the presence of slots 14 on carrying arm 10*a* simplifies the process for users.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGS.

| |
|---|
| 1 apparatus portion |
| 1a apparatus |
| 1b apparatus |
| 1c apparatus |
| 1d apparatus |
| 2 dispensing lid |
| 3 spout |
| 4 liquid container |

-continued

TABLE OF REFERENCE NUMERALS FOR FIGS.

| |
|---|
| 5 hinge lug |
| 6 hinge post |
| 7 gap |
| 8 tab |
| 10a carrying arm |
| 10b carrying arm |
| 12 collar |
| 13 first end |
| 14 slot |
| 15 second end |
| 16 handle |
| 20 carrying arm |
| 22 collar |
| 23 first end |
| 24 slot |
| 25 second end |
| 26 handle |
| 28 shank |
| 30 carrying arm |
| 32 collar |
| 33 first end |
| 34 slot |
| 35 second end |
| 36 handle |
| 38 shank |
| 40a carrying arm |
| 40b carrying arm |
| 42 collar |
| 44 slot |
| 46 handle |
| 50 arrow |
| 52 arrow |
| 54 arrow |
| 56 arrow |

What is claimed is:

1. A drinkware apparatus comprising:

a liquid container with a reservoir therein, the liquid container having an exterior surface;

a dispensing lid that engages with the liquid container, the dispensing lid having an exterior surface;

a pair of hinge lugs extending outwardly from the exterior surface of the liquid container or outwardly from the exterior surface of the dispensing lid, each of the hinge lugs having a mounting surface that opposes the mounting surface of the other hinge lug;

a pair of opposing hinge posts, each of which continuously extends from the mounting surface of a respective one of the hinge lugs and is positioned between the hinge lugs; and a carrying arm that is rotatable about the hinge posts when mounted directly on the hinge posts, the carrying arm being selectively removable from and selectively remountable on the hinge posts without adjustment of the hinge posts, hinge lugs, dispensing lid, or liquid container.

2. The apparatus of claim 1, wherein the dispensing lid comprises a spout through which liquid can be selectively removed from the liquid container through the dispensing lid while the dispensing lid is engaged with the liquid container.

3. The apparatus of claim 1, wherein the dispensing lid releasably engages with the liquid container and, thereby, selectively seals the reservoir when engaged with the liquid container.

4. The apparatus of claim 1, wherein the hinge lugs are on the dispensing lid.

5. The apparatus of claim 1, wherein the carrying arm is rotatable approximately 180° or more about the hinge posts when mounted directly thereon.

6. The apparatus of claim 1, wherein the carrying arm is selectively removable from and selectively remountable on the hinge posts further without changing a structural configuration of the carrying arm other than its mounting on the hinge posts.

7. The apparatus of claim 1, wherein the hinge posts are positioned on the hinge lugs with a gap between the hinge posts and the liquid container or the dispensing lid and at least a part of the carrying arm passes through the gap when the carrying arm rotates about the hinge posts when mounted directly thereon.

8. The apparatus of claim 7, wherein the hinge posts are offset from a central portion of the hinge lugs at a lower portion of the hinge lugs.

9. The apparatus of claim 7, wherein the carrying arm comprises a collar and a handle connected to the collar, the collar being rotatable about the hinge posts when mounted directly thereon, the collar being selectively removable from and selectively remountable on the hinge posts without adjustment of the hinge posts, hinge lugs, dispensing lid, or liquid container, the collar fitting between the hinge posts during the selective mounting thereon, and at least a part of the collar passing through the gap when the collar rotates about the hinge posts when mounted directly thereon.

10. The apparatus of claim 9, wherein the collar comprises one or more slot that corresponds to one or more of the hinge posts, the one or more of the hinge posts passing through the corresponding slot when removing and remounting the collar on the hinge posts.

11. The apparatus of claim 10, wherein the collar comprises a pair of opposing slots that align with the pair of opposing hinge posts, each of the hinge posts passing through the corresponding slot when removing and remounting the collar on the hinge posts.

12. The apparatus of claim 9, wherein the collar comprises an elongate loop with:

a first longitudinal end free to rotate about the hinge posts when the first end engages the hinge posts; and an opposing second longitudinal end connected to the handle; and wherein the collar can slide through the gap into one or more secured positions in which the collar is not rotatable when the second end engages the hinge posts.

13. The apparatus of claim 12, wherein the first longitudinal end is rounded.

14. The apparatus of claim 9, wherein the handle comprises a loop separate from the collar, the loop and the collar having a border in common.

15. The apparatus of claim 9, wherein the handle comprises a loop separate from the collar, the loop and the collar not having a border in common, and the loop being connected to the collar with a shank.

16. The apparatus of claim 9, wherein the handle comprises a tee separate from the collar, the tee and the collar not having a border in common, and the tee being connected to the collar with a shank.

17. The apparatus of claim 9, wherein the collar comprises a portion of a loop and the handle comprises another portion of the same loop.

18. A drinkware apparatus comprising:

a liquid container with a reservoir therein, the liquid container having an exterior surface;

a dispensing lid that engages with the liquid container, the dispensing lid having an exterior surface and a spout through which liquid can be selectively removed from the liquid container through the dispensing lid while the dispensing lid is engaged with the liquid container, the dispensing lid releasably engaging with the liquid container and, thereby, selectively sealing the reservoir when engaged with the liquid container;

a pair of hinge lugs extending outwardly from the exterior surface of the dispensing lid, each of the hinge lugs having a mounting surface that opposes the mounting surface of the other hinge lug;

a pair of opposing hinge posts, each of which continuously extends from the mounting surface of a respective one of the hinge lugs and is positioned between the hinge lugs; and a carrying arm that is rotatable about the hinge posts when mounted directly on the hinge posts, the carrying arm being selectively removable from and selectively remountable on the hinge posts without adjustment of the hinge posts, hinge lugs, dispensing lid, or liquid container.

19. The apparatus of claim 18, wherein the hinge posts are positioned on the hinge lugs with a gap between the hinge posts and the dispensing lid and at least a part of the carrying arm passes through the gap when the carrying arm rotates about the hinge posts when mounted directly thereon.

20. The apparatus of claim 19, wherein the carrying arm comprises a collar and a handle connected to the collar, the collar being rotatable about the hinge posts when mounted directly thereon, the collar being selectively removable from and selectively remountable on the hinge posts without adjustment of the hinge posts, hinge lugs, dispensing lid, or liquid container, the collar fitting between the hinge posts during the selective mounting thereon, and at least a part of the collar passing through the gap when the collar rotates about the hinge posts when mounted directly thereon.

21. A drinkware apparatus comprising:

a liquid container with a reservoir therein, the liquid container having an exterior surface;

a dispensing lid that engages with the liquid container, the dispensing lid having an exterior surface;

a pair of hinge lugs extending outwardly from the exterior surface of the dispensing lid, each of the hinge lugs having a mounting surface that opposes the mounting surface of the other hinge lug;

a pair of opposing hinge posts, each of which continuously extends from the mounting surface of a respective one of the hinge lugs and is positioned between the hinge lugs, the hinge posts being positioned on the hinge lugs with a gap between the hinge posts and the dispensing lid; and a carrying arm including:

a collar that is rotatable about the hinge posts when mounted directly on the hinge posts, the collar being selectively removable from and selectively remountable on the hinge posts without adjustment of the hinge posts, hinge lugs, dispensing lid, or liquid container, the collar fitting between the hinge posts during the selective mounting thereon, and at least a part of the collar passing through the gap when the collar rotates about the hinge posts when mounted directly thereon; and a handle connected to the collar.

22. The apparatus of claim 1, wherein the carrying arm is selectively removable from and selectively remountable on the hinge posts without adjustment of the hinge posts, hinge lugs, dispensing lid, or liquid container, which adjustment includes disassembly of the hinge posts, hinge lugs, dispensing lid, or liquid container.

23. The apparatus of claim 6, wherein the carrying arm is selectively removable from and selectively remountable on the hinge posts further without changing a structural configuration of the carrying arm other than its mounting on the hinge posts, which structural configuration includes a position of a clip, catch, gate, or other retaining structure.

* * * * *